US007566292B1

(12) United States Patent
Hauser et al.

(10) Patent No.: US 7,566,292 B1
(45) Date of Patent: Jul. 28, 2009

(54) HANDLE ASSEMBLY FOR USE WITH AN EXERCISE BAR

(75) Inventors: Stephen G. Hauser, Tarzana, CA (US); Mark B. Friedman, Simi Valley, CA (US); Alden M Mills, Kentfield, CA (US)

(73) Assignee: Perfect Pushup, LLC, Mill Valley, CA (US)

( * ) Notice: Subject to any disclaimer, the term of this patent is extended or adjusted under 35 U.S.C. 154(b) by 0 days.

(21) Appl. No.: 12/425,760

(22) Filed: Apr. 17, 2009

(51) Int. Cl.
*A63B 21/00* (2006.01)
*A63B 1/00* (2006.01)
*A63B 21/068* (2006.01)
*A45C 13/26* (2006.01)

(52) U.S. Cl. ..... 482/92; 482/40; 482/96; 16/422

(58) Field of Classification Search ..... 482/37, 482/40, 49, 92, 96, 904; 223/85, 88; 16/422, 16/426, 110.1, 406; 403/33, 43, 44
See application file for complete search history.

(56) References Cited

U.S. PATENT DOCUMENTS 1,386,721 A * 8/1921 Madden et al. ..... 29/221
1,824,941 A * 9/1931 Winder ..... 294/26
2,087,757 A * 7/1937 Foss ..... 211/119.008
2,919,134 A * 12/1959 Zuro ..... 482/129
2,972,419 A * 2/1961 Eli et al. ..... 211/119.004
3,424,422 A * 1/1969 Klangos ..... 248/561
3,614,097 A * 10/1971 Blickman ..... 482/72
3,645,212 A 2/1972 Dahlstrom
3,716,232 A * 2/1973 Johnson et al. ..... 482/40
4,529,191 A * 7/1985 Miller et al. ..... 482/40
4,750,697 A * 6/1988 Tontarelli ..... 248/215
4,756,527 A * 7/1988 Ledbetter ..... 482/139
4,844,448 A * 7/1989 Niznik ..... 482/40
4,858,977 A * 8/1989 Mitchell ..... 294/82.1
4,867,444 A * 9/1989 Castillo ..... 482/106
4,893,715 A * 1/1990 Papazian et al. ..... 211/118
4,911,572 A * 3/1990 Williams ..... 403/209
5,107,996 A * 4/1992 Whittaker ..... 211/116
5,224,607 A * 7/1993 Koresko ..... 211/34
5,480,075 A * 1/1996 Robinson ..... 223/88
5,573,484 A * 11/1996 Carpenter ..... 482/108
5,588,942 A * 12/1996 Dillard ..... 482/139
5,722,118 A * 3/1998 Hansen et al. ..... 16/113.1
5,924,667 A * 7/1999 Grahn et al. ..... 248/304

(Continued)

FOREIGN PATENT DOCUMENTS

EP 0116670 A 4/1983

(Continued)

*Primary Examiner*—LoAn H. Thanh
*Assistant Examiner*—Allana Lewin
(74) *Attorney, Agent, or Firm*—Charter IP, LLC; Matthew J. Lattig

(57) ABSTRACT

A handle assembly adapted to grasp a bar for exercise includes a J-shaped hook for placement on the bar, a rotation assembly, and a handle attached to the rotation assembly. The handle has an inverted U-shaped bracket with a cross piece defining a grip that is connected between ends of the U-bracket. The rotation assembly is connected between a lower end of the hook and the U-shaped bracket and includes a bearing, the handle being rotatable via the bearing by a user during exercise with the J-hook on the bar.

5 Claims, 9 Drawing Sheets

U.S. PATENT DOCUMENTS

| | | | | |
|---|---|---|---|---|
| 6,328,679 | B1 * | 12/2001 | Croft | 482/129 |
| 6,416,447 | B1 | 7/2002 | Harmon | |
| 6,454,145 | B1 * | 9/2002 | Russ | 223/85 |
| 7,066,866 | B1 * | 6/2006 | Mobley | 482/40 |
| 7,232,105 | B2 * | 6/2007 | Want et al. | 248/691 |
| 7,316,324 | B1 * | 1/2008 | Myllykangas | 211/16 |
| 2003/0186793 | A1 | 10/2003 | Chen | |
| 2005/0085352 | A1 | 4/2005 | Baxter | |
| 2009/0017669 | A1 * | 1/2009 | Wu | 439/352 |

FOREIGN PATENT DOCUMENTS

| | | | |
|---|---|---|---|
| JP | S53-40191 | Y | 9/1978 |
| JP | H08-257164 | A | 10/1996 |
| JP | 0912267 | A | 5/1997 |

* cited by examiner

HANDLE ASSEMBLY FOR USE WITH AN EXERCISE BAR

PRIORITY STATEMENT

This application claims priority under 35 U.S.C. §120 to co-pending application Ser. No. 12/042,368 to Stephen G. Hauser, et al., filed Mar. 5, 2008 in the United States Patent & Trademark Office and entitled "PULLUP EXERCISE ASSEMBLY WITH ROTATABLE HANDLES AND PIVOTABLE BAR", the disclosure of which is incorporated herein in its entirety by reference.

BACKGROUND

1. Field of the Invention

Example embodiments of the present invention generally relate to rotatable handle assembly for use with an exercise bar that enhances a pullup and/or chin-up exercise, for example.

2. Description of Related Art

Pullups and chin-ups are exercises consisting of chinning oneself, as on a horizontal bar attached at each end to a frame of a door or doorpost, or of chinning oneself on other outdoor or fitness equipment. Both are compound exercises designed to work the muscles of the upper body. Basically, the difference lies in the grip. One performing a chin-up uses a narrow grip with the palms facing inward, while a pullup is done with typically a wider grip on the bar and with the palms facing outward.

Traditionally, the exercise of performing a pullup or chin-up places substantial strain on the joints and is limited to exercising certain muscles in the arms, neck and back. Pullup bars with rotatable handle assemblies have been developed to exercise additional muscles in the arms, neck and back. However, these systems do not address or facilitate core muscle exercises (abdominal, trunk).

SUMMARY

An example embodiment is directed to a handle assembly adapted to grasp a bar for exercise. The handle assembly includes a J-shaped hook for placement on the bar, a curved portion forming an upper end of the J-hook adapted to grasp the bar to secure the handle assembly to the bar, a rotation assembly, and a handle attached to the rotation assembly, the handle having an inverted U-shaped bracket with a cross piece defining a grip that is connected between ends of the U-bracket. The rotation assembly is arranged between a lower end of the J-hook and the handle, and includes a bearing having a fastener extending there through that is received within the J-hook lower end to attach the J-hook to the handle. The bearing facilitates rotational movement of the handle. A user grasps the handle to place the curved portion of the J-hook over the bar. The handle is rotated by the user during exercise, via the bearing, about a vertical axis of the J-hook.

Another example embodiment is directed to a handle assembly adapted to grasp a bar for exercise. The handle assembly includes a J-shaped hook for placement on the bar, a rotation assembly and a handle attached to the rotation assembly. The handle has an inverted U-shaped bracket with a cross piece defining a grip that is connected between ends of the U-bracket. The rotation assembly is connected between a lower end of the hook and the U-shaped bracket and includes a bearing, the handle being rotatable via the bearing by a user during exercise with the J-hook on the bar.

BRIEF DESCRIPTION OF THE DRAWINGS

Example embodiments of the present invention will become more fully understood from the detailed description given herein below and the accompanying drawings, wherein like elements are represented by like reference numerals, which are given by way of illustration only and thus do not limit the example embodiments.

DETAILED DESCRIPTION

The example embodiments in general relate to a pullup exercise assembly that includes rotatable handle assemblies and a pivotable bar assembly which can be oriented and secured into various positions between two vertical surfaces, such as the doorposts or sides of a door frame. The example exercise assembly can combine the pullup and chin-up exercise, and can be used for performing core exercises such as an inverted pushup (known as an "Australian pullup"), standing row exercise and a dip exercise, for example.

Figure 1:
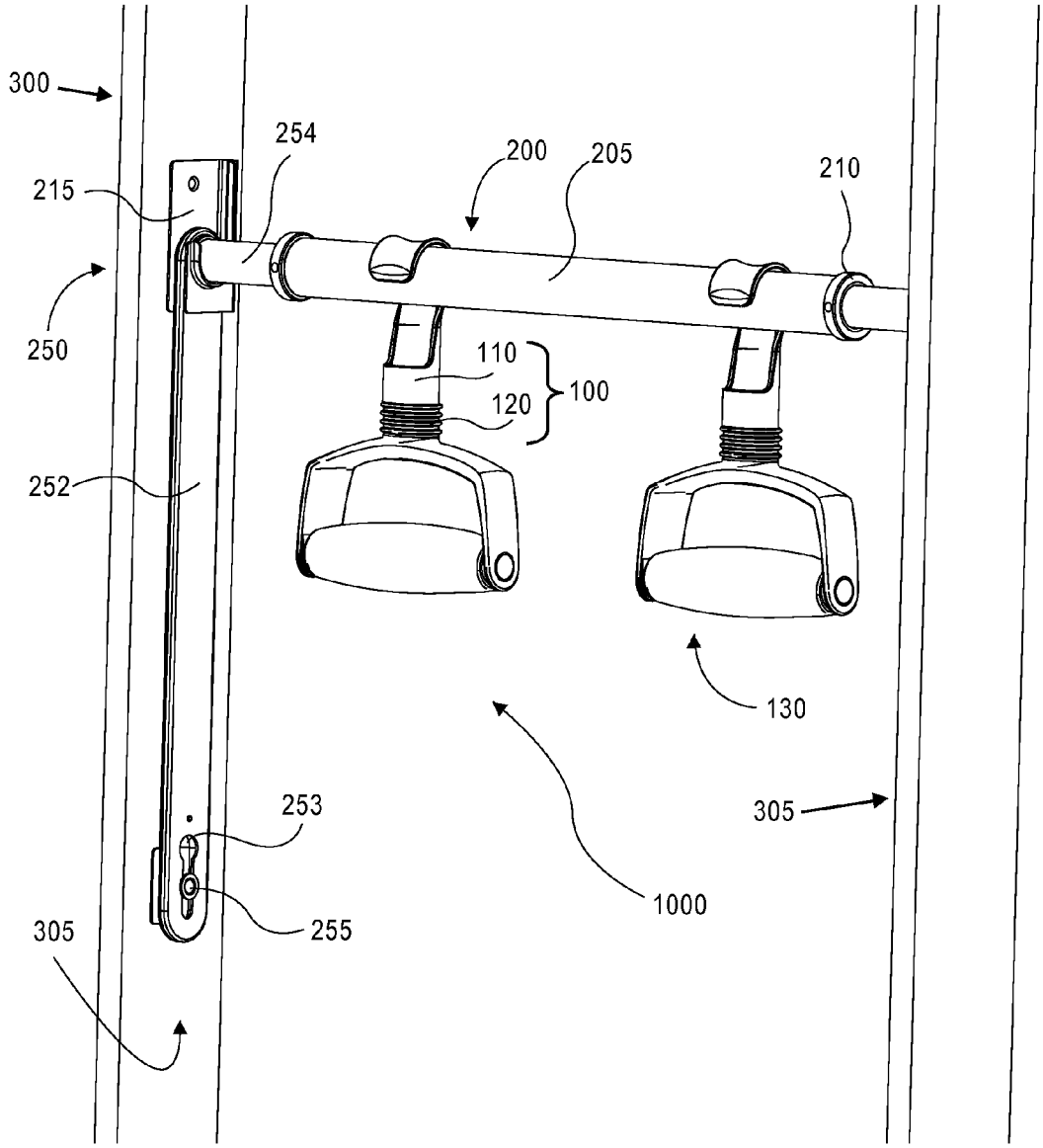
FIG. 1 is a perspective view of an exercise assembly in accordance with the example embodiments.

FIG. 1 is a perspective view of an exercise assembly in accordance with the example embodiments. The pullup exercise assembly, hereafter "exercise assembly 1000", is shown positioned between vertical surfaces 305 of a frame 300. The exercise assembly 1000 includes a bar assembly 200 comprising a central bar 205 connected between a pair of side arm assemblies 250. The central bar 205 may include a rubber overmold grip, for example. One or more handle assemblies 100 can be affixed to the central bar 205 via a J-hook 110 that forms part of the handle assembly 100.

The handle assembly 100 includes a J-hook 110, a rotation assembly 120, and a handle 130. The J-hook 110 grips the central bar 205. The J-hook 110 is connected to the rotation assembly 120, which in turn is connection to the handle 130. The J-hook 110 remains fixed in place as the handle 130 can be rotated around the axis of the J-hook 110 via the rotation assembly 120.

Each side arm assembly 250 includes a vertical side strut 252 connected to a horizontal end stub 254. The end stub 254 can be welded to the side strut 252. The side struts 252 extend along the vertical surface 305 between an upper hook mount 215 (which receives the portion of the side-arm assembly where the end stub 254 is attached to the side strut 254) and a lower mount 251 which includes a pivot pin 255 that extends through a slotted aperture 253 in the side strut 252.

The bar assembly 200 can pivot about the pivot pins 255. In an example, the bar assembly 200 is first lifted out of the upper hook mounts 215 to unlock the pivot pin 255, such that the pin 255 slides down into the wider part of the slotted aperture 253. The bar assembly 200 can then be rotated to a desired angle from vertical to perform a different exercise such as a dip, standing row, inverted pullup, etc.

As shown in FIG. 1, the bar assembly 200 includes a central hollow metal bar 205, which can be covered with an overmold grip, as previously described. The central bar 205 is dimensioned so that its inner diameter is slightly larger than the outer diameter of the end stubs 254. Accordingly, the end stubs 254 are received within the central bar 205, and may be secured via retaining rings 210.

Figure 2:
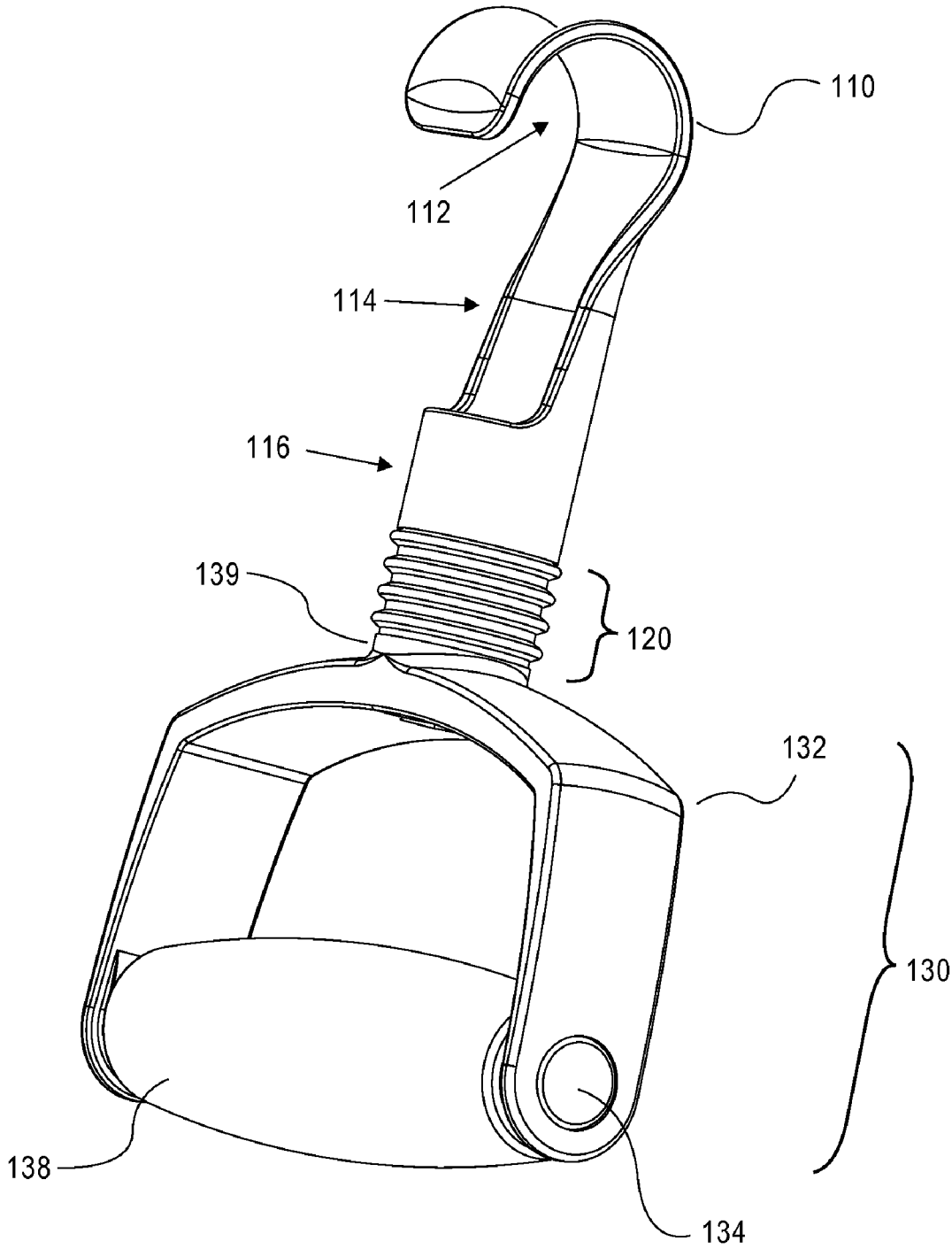
FIG. 2 is a perspective view of the handle assembly in accordance with the example embodiments.

FIG. 2 is a perspective view of the handle assembly in accordance with the example embodiments. The handle assembly 100 is a standalone component; in other words it is freely removable from the bar 205 and is not fixed to the central bar 205 by a connection means which requires assembly/disassembly, such as a pin, screw or actuation mechanism which locks and unlocks the handle assembly 100 from the central bar 205.

The J-hook 110 includes an upper curved portion 112, an elongate intermediate body that is generally semi-circular in shape and which forms a circular shape at a base 116 of the hook 110. The J-hook 110 may be made of a metal material such as steel (which may be painted for stylistic purposes), and alloy thereof, aluminum, etc. The handle 130 is connected to the rotation assembly 120 at a neck 139. The handle 130 includes a metal U-bracket 132 having a grip member 138 secured therein by way of threaded fasteners 134. The U-bracket 132 may be made of a medium or heavy gauge impact plastic such as acrylonitrile butadiene styrene (ABS), or of a metal material such steel, and alloy thereof, cast aluminum, etc. The fasteners 134 may be pins for example.

Figure 3:
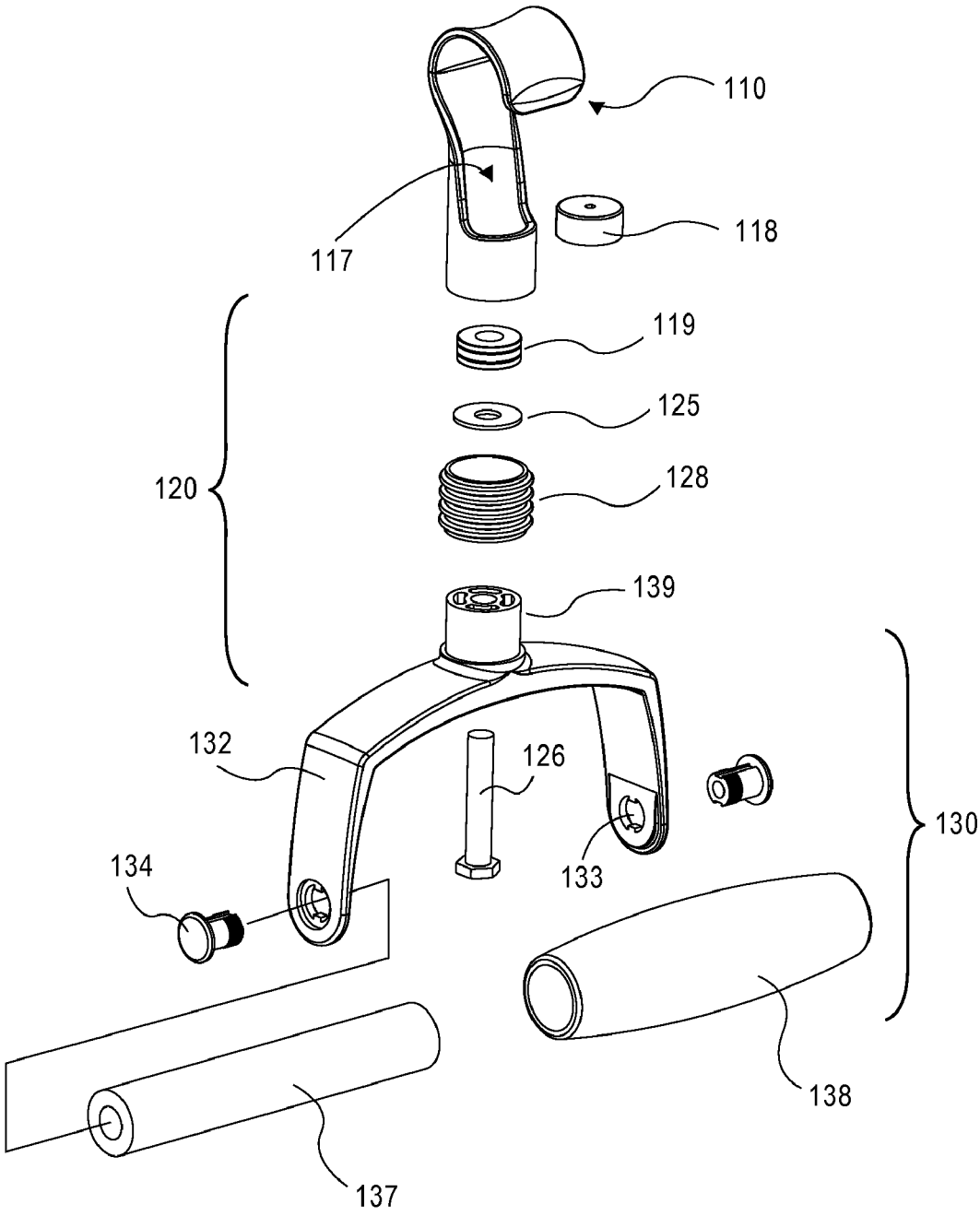
FIG. 3 is an exploded view of the handle assembly of FIG. 2 to illustrate components in greater detail.

FIG. 3 is an exploded view of the handle assembly of FIG. 2 to illustrate components in greater detail. The rotation assembly 120 includes a generally circular or cylindrical bearing 119 which is positioned between a washer 125 and an internally threaded plug 118. The bearing 119 permits the handle 130 to be rotated 360 degrees in either direction around a vertical axis of the J-hook 110 that is perpendicular to the bar 205 during exercise. The plug 118 receives a hex bolt 126 such that the external threads on bolt 126 mate with internal threads within plug 118 to connect the J-hook 110 with handle 130. The plug 118 has a hex head shape that is a standard profile for an Allen wrench, and fits into a bore 117 formed in base 116. As can be seen in FIG. 3, bolt 126 extends through neck 139, washer 125 and bearing 119, to be threaded into the plug 118.

The rotation assembly 120 includes a rubber bellow 128 between the hook 110 and the neck 139 of the handle 130. At its top, the rubber bellow 128 attaches to the base 116 of the J-hook 110. The rubber bellow 128 mates with the neck 139 of handle 130 at its bottom so that a portion of the neck 139 contacts an interior surface of the bellow 128. The rubber bellow 128 encloses the washer 125 and a portion of the bolt 126 extending there through.

The handle 130 includes a hollow metal shaft 137 overlaid with or sheathed within grip member 138. Shaft 137 may be composed of chrome steel or aluminum, for example, and is secured to arms of the U-bracket 132 via insertion of fasteners 134 through holes 133 in the U-bracket 132. The grip member 138 may be made of a foam rubber or suitable elastomeric material and has a wider or thicker center portion which tapers down to the end portions of the grip member 148.

The bearing 119 has an opening for receiving the bolt 126. When the handle assembly 100 is assembled, the bearing 119 fits up into a bore 117 formed within the base 116 of the J-hook 110, contacting an underside surface of plug 118.

Figure 5:
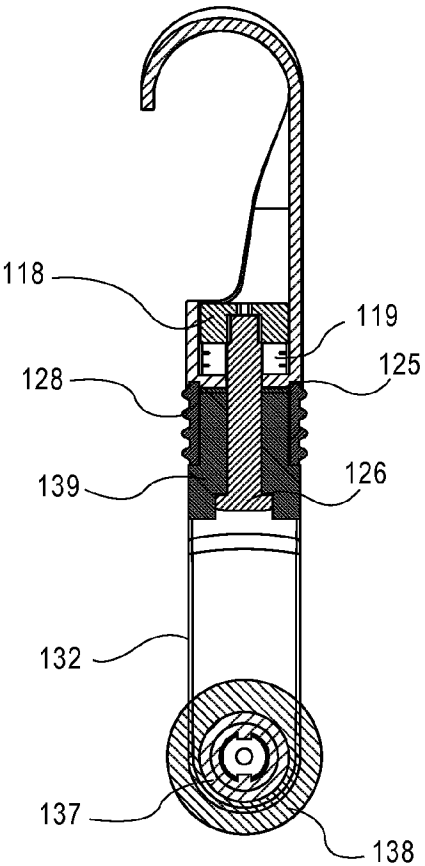
FIG. 5 is a cross-section view of the handle assembly in FIG. 4 taken across a line A-A.
Figure 4:
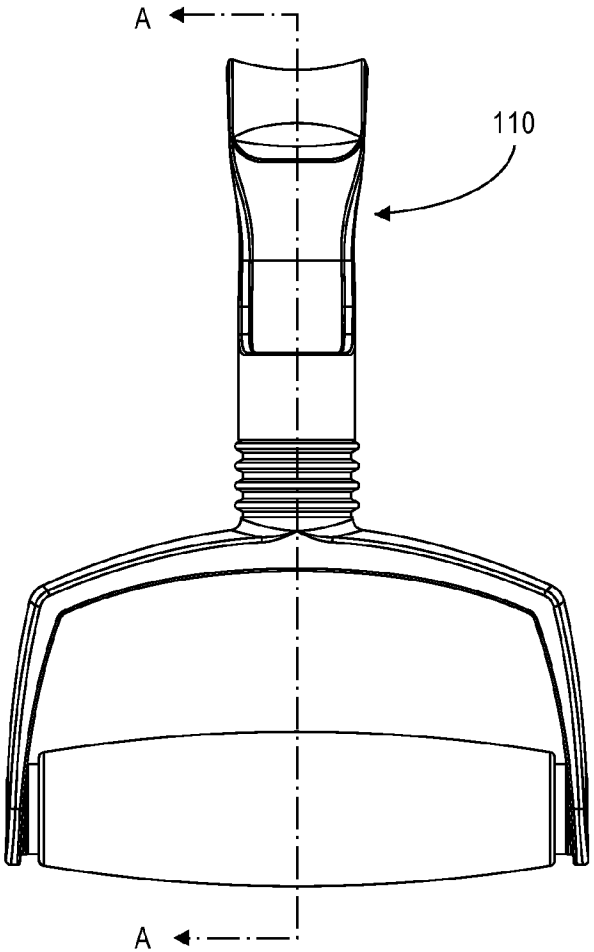
FIG. 4 is a front view of the handle assembly of FIG. 2.

FIG. 4 is a front view of the handle assembly of FIG. 2, and FIG. 5 is a cross-section view of the handle assembly in FIG. 4 taken across a line A-A. Referring to FIGS. 4 and 5, the relationship between moving and fixed components with rotation assembly 120 can be seen in greater detail. The bearing 119 is designed to rotate around the fixed bolt 126 with the hook 110 being fixed on the central bar 205 and the user swiveling or rotating the handle 130 around the rubber bellow 128 such that the neck 139 and bearing 119 rotate together. Thus, the bearing 119 and handle 130 rotate together for desired rotational movement in either direction.

Figure 6:
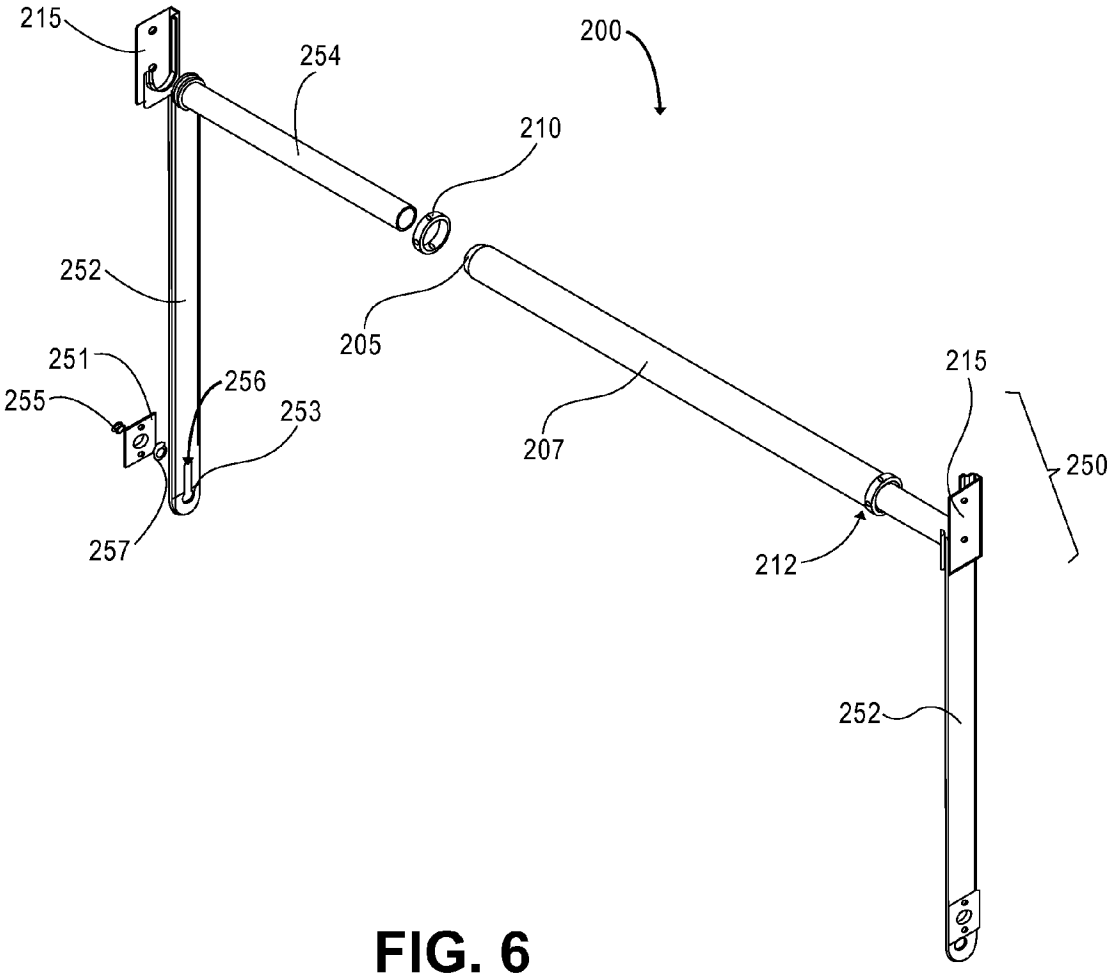
FIG. 6 is a partial exploded view of the bar assembly 200 to illustrate components in greater detail.
Figure 7:
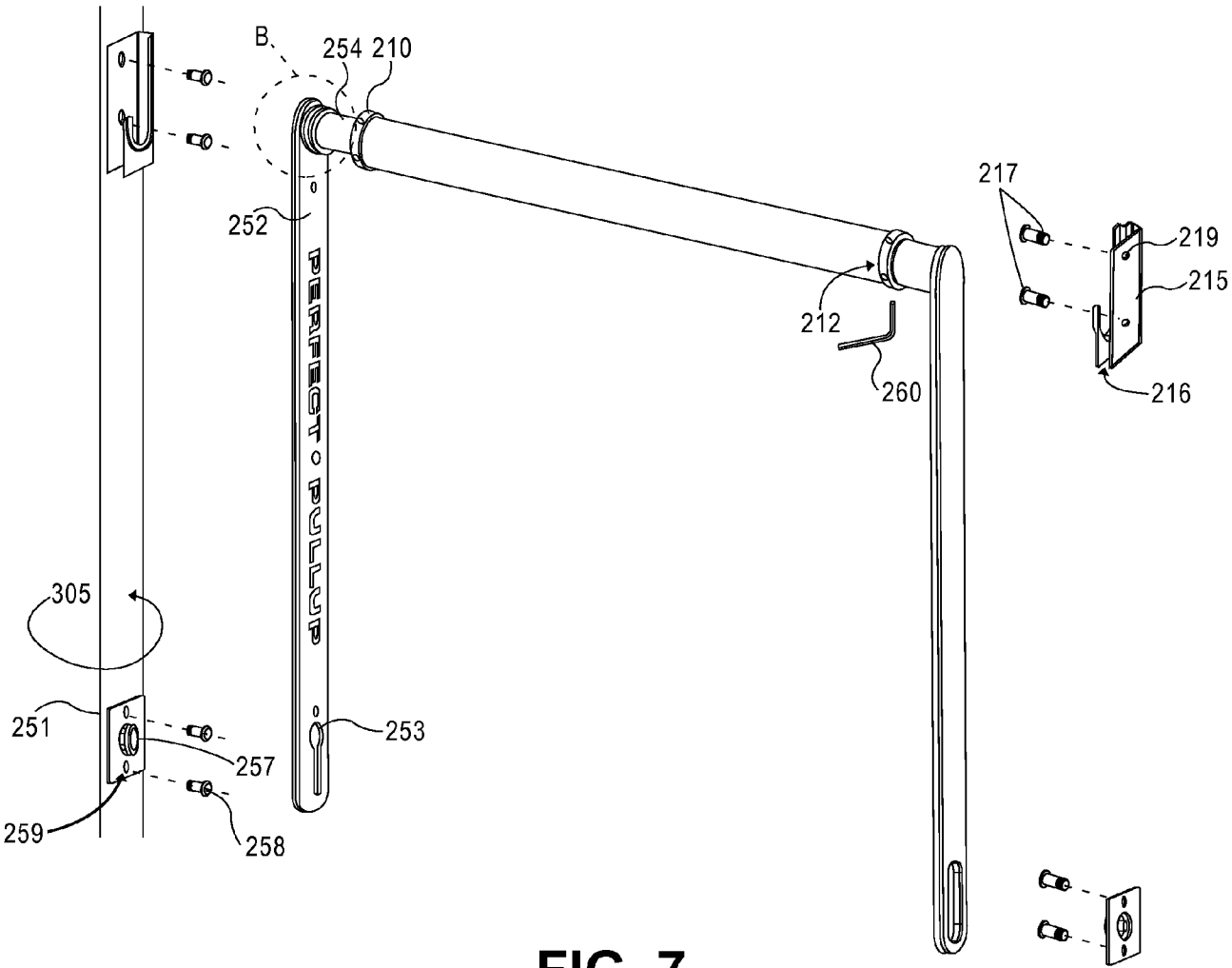
FIG. 7 is a partial exploded view of the bar assembly 200 to illustrate connection thereof between vertical surfaces.

FIG. 6 is a partial exploded view of the bar assembly 200 to illustrate components in greater detail, and FIG. 7 is a partial exploded view of the bar assembly 200 to illustrate connection thereof between vertical surfaces. Referring to FIGS. 6 and 7, the outer ends of each end stub 254 are attached to corresponding upper ends of the side struts 252. The portion of the side-arm assembly 250 shown in circle B of FIG. 7 is received into the upper hook mount 215. The upper hook mount 215 includes a channel 216 to receive the end of end stub 255 and top of side strut 252 at the intersection thereof. Thus, the channel 216 has a sufficient width to accommodate the upper portion of the side-arm assembly 250, as shown best in FIG. 7. The upper hook mount 215 is secured to a vertical surface 305 of a door frame 300 for example by suitable fasteners 217 (such as wood screws) through holes 219 formed in the upper hook mount 215.

A lower pivot mount 251 is provided to enable the bar assembly 200 to be pivotable, once the top of the assembly 200 is lifted out of the channels 216 of the hook mounts 215. The lower pivot mount 251 is secured to the vertical surface 305 by suitable fasteners 258 (such as wood screws) through holes 259 formed in the lower pivot mount 251. The lower pivot mount 251 contains the pivot pin 255. The pivot pin 255 has a post with a mushroom head 257 that is configured to extend into the larger opening of the slotted aperture 253. Once the desired location of the bar assembly 200 is set, i.e., the assembly 200 has either (a) been set for conventional pullup/chin-up exercises, or (b) has been pivoted to some desired angle from vertical for another exercise, the mushroom head 257 captures surfaces of the side struts 252.

For example, once the bar assembly 200 has been pushed downward so that the pivot pin 255 rides up the narrower channel 256 of slotted aperture 253, the mushroom head 257 of the pivot pin 255 captures surfaces of the side struts 252 along the slotted aperture 253. Exercising may begin. In one example, the bar assembly 200 can be removed from the channels 116 of the upper hook mounts 215 and rotated up to 180 degrees to a lower dimension, pivoting around the lower pivot mounts 251 so as to permit one to perform inverted pushup exercises from the ground up, a standing rowing exercise, a dip exercise etc.

Figure 8:
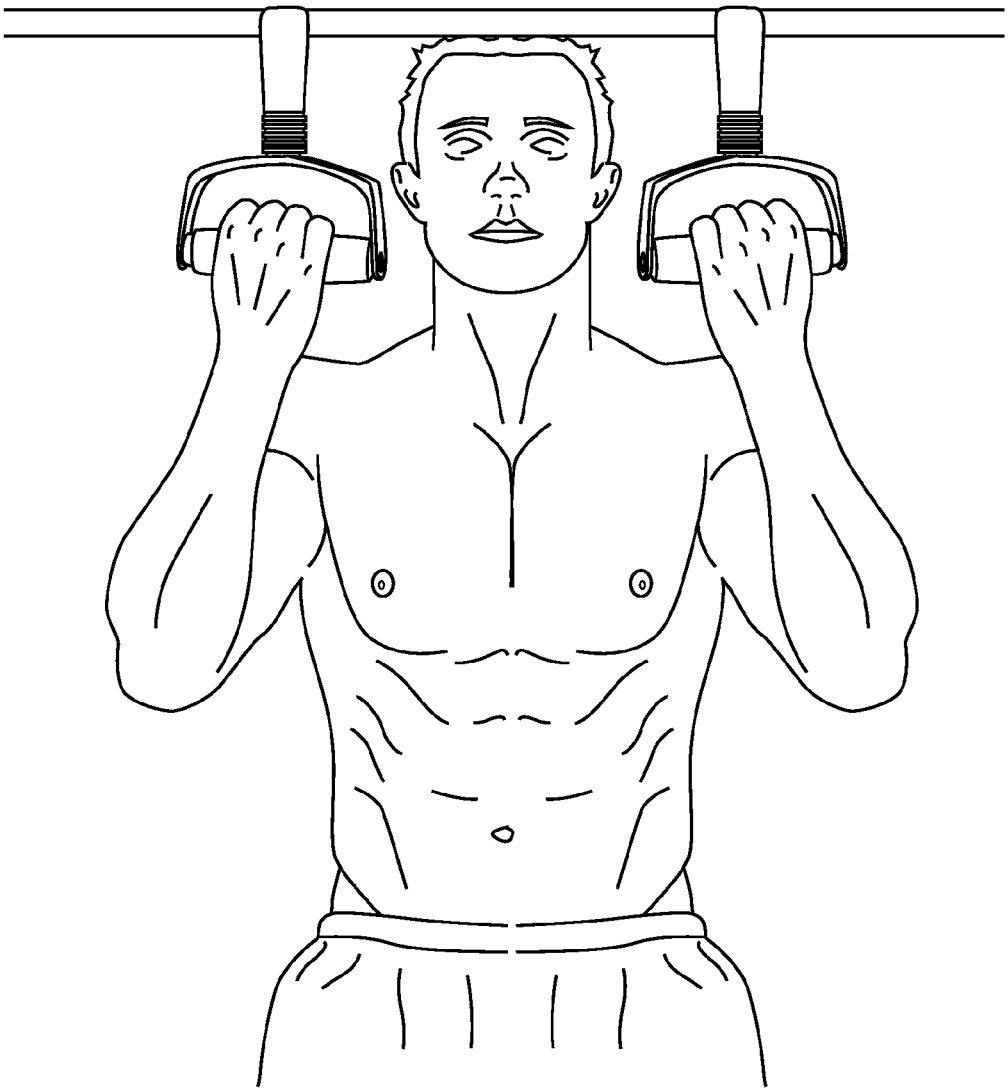
FIG. 8 illustrates a user performing a standard chin-up or pullup on the exercise assembly 1000.

FIG. 8 illustrates a user performing a conventional pullup or chin-up exercise on the exercise assembly 1000. Since the handle assemblies 100 swivel, the user's hands can rotate as the user is moving up and down, engaging additional muscle groups.

Figure 9:
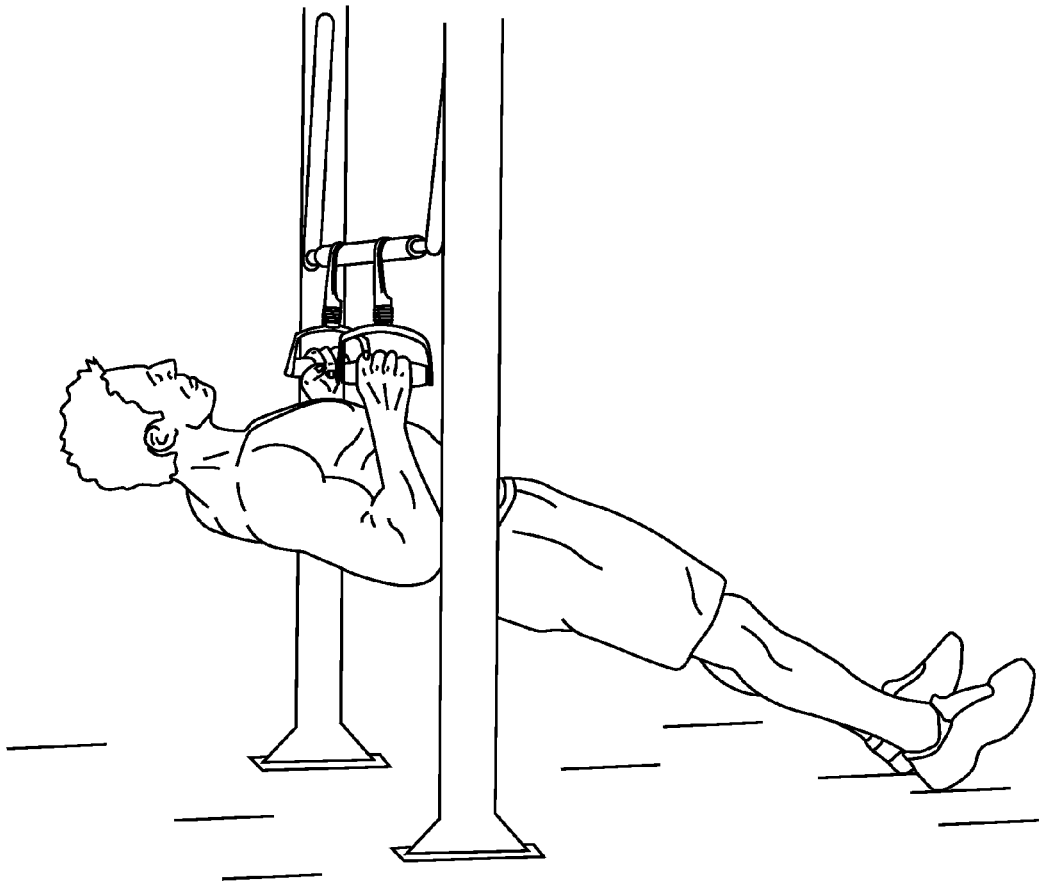
FIG. 9 illustrates a user performing an Australian pullup on the exercise assembly 1000.

FIG. 9 illustrates a user performing an Australian pullup on the exercise assembly 1000. In this example, the fitness trainer has oriented the exercise assembly 1000 such that the side struts 252 and central bar 205 have been rotated downward approximately 180 degrees from vertical. In this orientation, the trainer can perform a reverse pushup (Australian pullup) to work different muscles than can be achieved with a conventional pullup/chin-up bar.

Figure 10:
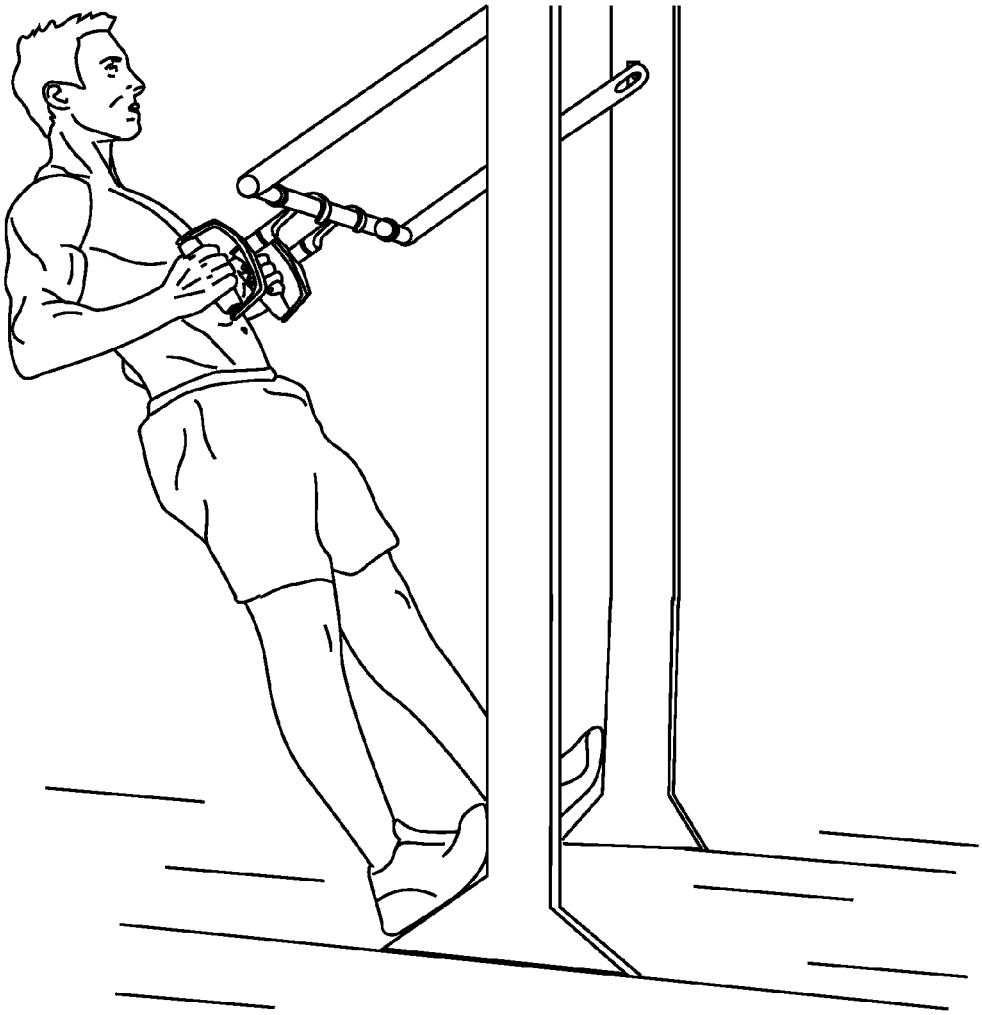
FIG. 10 illustrates a user performing a standing row on the exercise assembly 1000.

FIG. 10 illustrates a user performing a standing row on the exercise assembly 1000. In this example, the fitness trainer has oriented the exercise assembly 1000 such that the side struts 252 and central bar 205 have been rotated downward approximately 120 degrees from vertical. In this orientation, the trainer can perform a rowing exercise to work the core abdominal muscles, in addition to working the biceps, deltoids, pectorals and other back muscles.

FIGS. 8 through 10 are merely example orientations of the exercise assembly 1000 to perform exercises other than standard pull-ups or chin-ups. It would be evident to one or skill in the art to re-position the side-arm assemblies 250 and central bar 205 to perform exercises other than shown in FIGS. 8-10.

Therefore, unlike traditional pullup or chin-up bars that limit the user's range of motion, the example exercise assembly 1000 includes twisting handles 130 on adjustable swing arms 250 which attach to the central bar 205 to maximize muscle motion. The handle assemblies 100 incorporate bearings 119 to enable 360 degree rotation. This permits the user's arms to move naturally, reduces strain on joints, and engages additional muscle groups as compared to the standard pullup bar. The example exercise assembly 1000 thus may combine the standard pullup and chin-up exercises into one, and can facilitate additional workouts to core and abdominal muscle groups.

The example embodiments being thus described, it will be obvious that the same may be varied in many ways. Such variations are not to be regarded as departure from the embodiments of the present invention. All such modifications as would be obvious to one skilled in the art are intended to be included within the following claims.

What is claimed is:

1. A handle assembly adapted to grasp a bar for exercise, comprising:

a J-shaped hook for placement on the bar, a curved portion forming an upper end of the J-hook adapted to grasp the bar to secure the handle assembly to the bar, a rotation assembly, and a handle attached to the rotation assembly, the handle having an inverted U-shaped bracket with a cross piece defining a grip that is connected between ends of the U-bracket, the cross piece comprising a hollow, metal shaft sheathed within a rubberized grip, the shaft secured between the downward extending ends of the U-bracket by threaded fasteners, wherein the rotation assembly is arranged between a lower end of the J-hook and the handle, the rotation assembly including a bearing having a fastener extending there through that is received within the J-hook lower end to attach the J-hook to the handle, the bearing facilitating rotational movement of the handle, and a user grasps the handle to place the curved portion of the J-hook over the bar, the handle rotated by the user during exercise, via the bearing, about a vertical axis of the J-hook.

2. The assembly of claim 1 wherein the fastener is an elongate bolt extending through the bearing to be received in a threaded opening within the lower end of the J-hook for attaching the J-hook to the handle.

3. The assembly of claim 2, wherein the inverted U-bracket includes an upper horizontal member with a neck integrally formed at a central location thereon, the neck having a bore for retaining a head end of the bolt therein so that the handle rotates with the bearing, and.

4. The assembly of claim 3, wherein a first diameter of the grip is wider at a center of the grip than a second diameter at the grip ends.

5. A handle assembly adapted to grasp a bar for exercise, comprising:

a J-shaped hook for placement on the bar, a rotation assembly, a handle attached to the rotation assembly, the handle having an inverted U-shaped bracket with a cross piece defining a grip that is connected between ends of the U-bracket, wherein the rotation assembly is connected between a lower end of the hook and the U-shaped bracket and includes a bearing, the handle rotatable via the bearing by a user during exercise with the J-hook on the bar, wherein the bearing has a bolt extending there through that is received within the J-hook lower end to attach the J-hook to the handle, wherein the inverted U-bracket includes an upper horizontal member with a neck integrally formed at a central location thereon, the neck having a bore for retaining a head end of the bolt therein so that the handle rotates with the bearing, and wherein the cross piece comprises a hollow, metal shaft sheathed within a rubberized grip, the shaft secured between downward extending ends of the U-bracket by threaded fasteners.

* * * * *